US006551260B2

(12) United States Patent
Suh

(10) Patent No.: US 6,551,260 B2
(45) Date of Patent: Apr. 22, 2003

(54) LEG MASSAGE DEVICE

(75) Inventor: Jeong-Joo Suh, Seoul (KR)

(73) Assignee: G-intek Co. Ltd (KR)

( * ) Notice: Subject to any disclaimer, the term of this patent is extended or adjusted under 35 U.S.C. 154(b) by 0 days.

(21) Appl. No.: 10/051,219

(22) Filed: Jan. 16, 2002

(65) Prior Publication Data

US 2003/0050578 A1 Mar. 13, 2003

(30) Foreign Application Priority Data

Sep. 11, 2001 (KR) ..... 01-55826

(51) Int. Cl.[7] ..... A61H 1/00

(52) U.S. Cl. ..... 601/99; 601/103; 601/108; 601/111; 601/149; 601/152

(58) Field of Search ..... 601/22, 27, 28, 601/111, 97–100, 101–104, 107–110, 33, 34, 46, 48, 51, 52, 148–152; 128/882, DIG. 20

(56) References Cited

U.S. PATENT DOCUMENTS 3,853,121 A * 12/1974 Mizrachy et al. ..... 128/882
3,880,150 A * 4/1975 Vileikis ..... 601/19
4,202,326 A * 5/1980 Van Gerpen ..... 601/103
4,535,760 A * 8/1985 Ikeda et al. ..... 318/120
4,660,548 A * 4/1987 Bucher ..... 482/79
5,755,677 A * 5/1998 Masuda et al. ..... 601/99
5,827,205 A * 10/1998 Iwamoto ..... 601/78
6,315,744 B1 * 11/2001 Inaba ..... 601/149

* cited by examiner

*Primary Examiner*—Danton D. DeMille
*Assistant Examiner*—Quang D Thanh
(74) *Attorney, Agent, or Firm*—Blakely Sokoloff Taylor & Zafman

(57) ABSTRACT

A massage device includes a main body provided with a supporting groove in which a calf of a leg can be disposed, a sliding member slidably inserted into the main body, and a first massager for massaging the calf. The first massager is installed on a rear side of the supporting groove and includes an electric motor, a power transmission device for converting a rotational motion of the motor into a reciprocal motion, and a first massage member for massaging the calf while moving along the supporting groove. The first massage member is fixed on the power transmission device.

9 Claims, 7 Drawing Sheets

LEG MASSAGE DEVICE

BACKGROUND OF THE INVENTION

1. Field of the Invention

The present invention relates to a massage device, and more particularly, to a leg massage device that can massage the foot including the sole and the calf in a variety of massage patterns.

2. Description of the Related Art

Generally, a massage device is used to obtain selected stroking, rubbing and/or kneading massaging effects of the human body to increase the blood flow and obtain muscle relaxation.

A body massage may be divided into three levels of rising intensities. The first level, known in the art as stroking, involves a smoothing action characterized by mile to medium pressure applied onto a body part being massaged. Stroking is meant to warm-up and thereby prepare the body part being massaged to the following massage levels. The second level, known in the art as rubbing, involves a pressing and rubbing action characterized by movement of the tissue and medium to high pressure applied on the body part being massage. Rubbing is meant to increase the blood flow in the body part being massaged. The third level, known in the art as kneading, involves a pressing and kneading actions characterized by high pressure applied onto the body part being massaged. Kneading is typically a deep and through muscle massage extends over a relatively prolonged time minutes or more.

Such massage devices may be categorized into a vibration-type massage device and a kneading/rubbing-type massage device. The vibration-type massage is designed to convert a rotation movement of a motor into a vibration movement of a massage head. The kneading/rubbing-type massage device is designed to convert a rotation movement into a rubbing/kneading movement of a massage element.

Particularly, the vibration-type massage device is used for massaging the sole of the foot by applying the vibration thereto.

In recent years, a massage device that can be used for a particular part of the human body and operated in a variety of patterns has been developed.

However, a massage device that is used for automatically massaging the leg, especially the calf has not yet proposed. That is, a variety of manual tools such as a wooden stick, a bottle, and a roller-type hand pressure have been used for rubbing the calf. The use of the manual tools for massaging the leg is troublesome.

SUMMARY OF THE INVENTION

Therefore, the present invention has been made in an effort to solve the above-described problems.

It is an objective of the present invention to provide a leg massage device that can be used for automatically massaging the sole of the foot and the calf in a variety of massaging patterns.

To achieve the above objectives, the present invention provides a massage device comprising a main body provided with a supporting groove in which a calf of a leg can be disposed; a sliding member slidably inserted into the main body; and first massage means for massaging the calf, the first massage means being installed on a rear side of the supporting groove and comprising an electric motor, power transmission means for converting a rotational motion of the motor into a reciprocal motion, and a first massage member for massaging the calf while moving along the supporting groove, the first massage member being fixed on the power transmission means.

The massage device may further comprise second massage means for massaging a sole of a foot, the second massage means being provided on the sliding member.

Preferably, the power transmission part comprises a driving gear coupled to the rotational shaft of the motor, a driven gear engaged with the driving gear, a driving shaft for fixing the driven gear and plural rotating members, the driving shaft being rotatably supported at its both ends on the supporting part to receive the driving force of the motor, and a belt connecting the rotating members to a supporting member to convert the rotational motion of the motor into the linear motion.

According to an embodiment, the first massage member comprises a fixing part fixed on the belt and plural rollers fixed on the fixing part and extending toward the supporting groove through a slot so as to massage the calf when the belt rotates.

The first massage member may further comprise a limit switch operated by contacting the fixing part so as to limit a reciprocal distance within a predetermined range.

The first massaging means may further comprise a second massage member that can apply pressure to the calf and release the pressure from the calf so as to perform the kneading massage.

Preferably, the second massage member comprises an air pump and plural pressing members connected to the air pump.

According to an embodiment, the second massage means comprises a solenoid vibrated by electric power from the power supplier controlled by the controller, impacting part coupled on a front end of an operating shaft of the solenoid, and a contacting part for transmitting the power of the impacting part to the sole of the foot.

Preferably, the solenoid comprises a bobbin with coil turns, the operating shaft inserted into a central hole of the bobbin, and a plate disposed spacing away from the bobbin and fixed to the bobbin by a fixing member.

An elastic member may be disposed between the operating shaft and the plate so as to enhance the smooth operation of the solenoid without noise.

Preferably, the main body is provided with a cylinder, and the sliding member is provided with a rod capable of being inserted into the cylinder, the rod tightly contacting the cylinder so as to prevent an abrupt movement of the sliding member.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

A preferred embodiment of the present invention will be described in detail with reference to the accompanying drawings.

Figure 1:
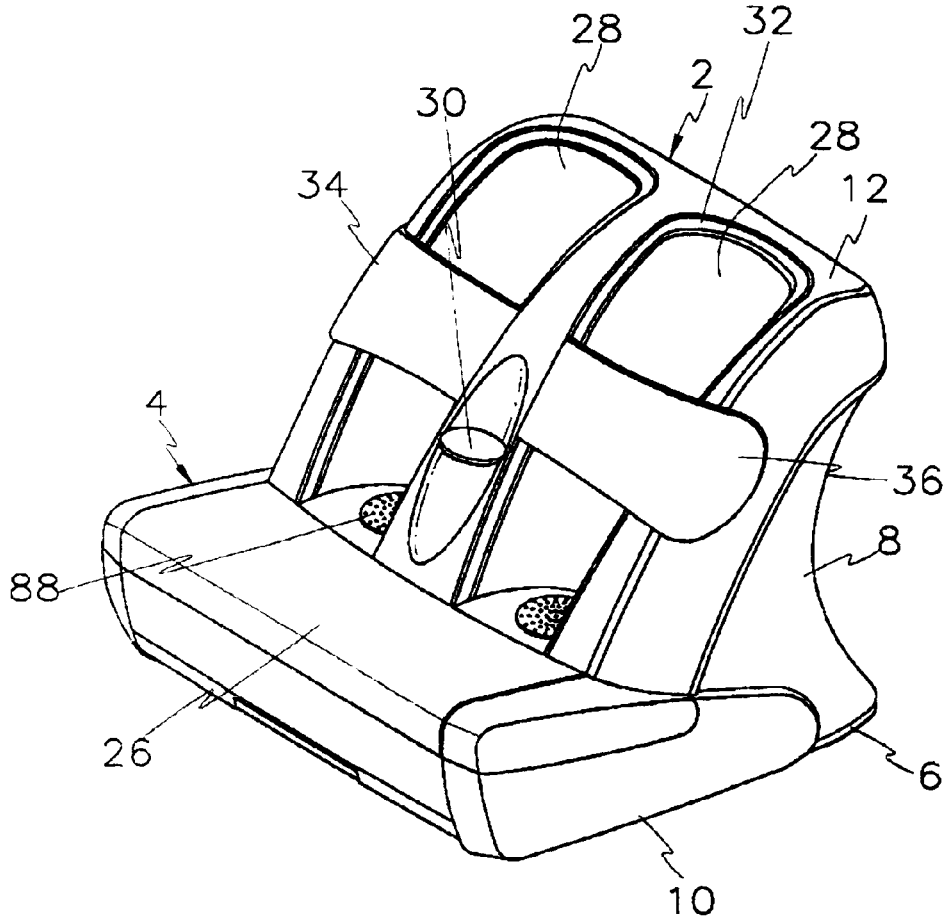
FIG. 1 is a perspective view of a leg massage device according to a preferred embodiment of the present invention.
Figure 2:
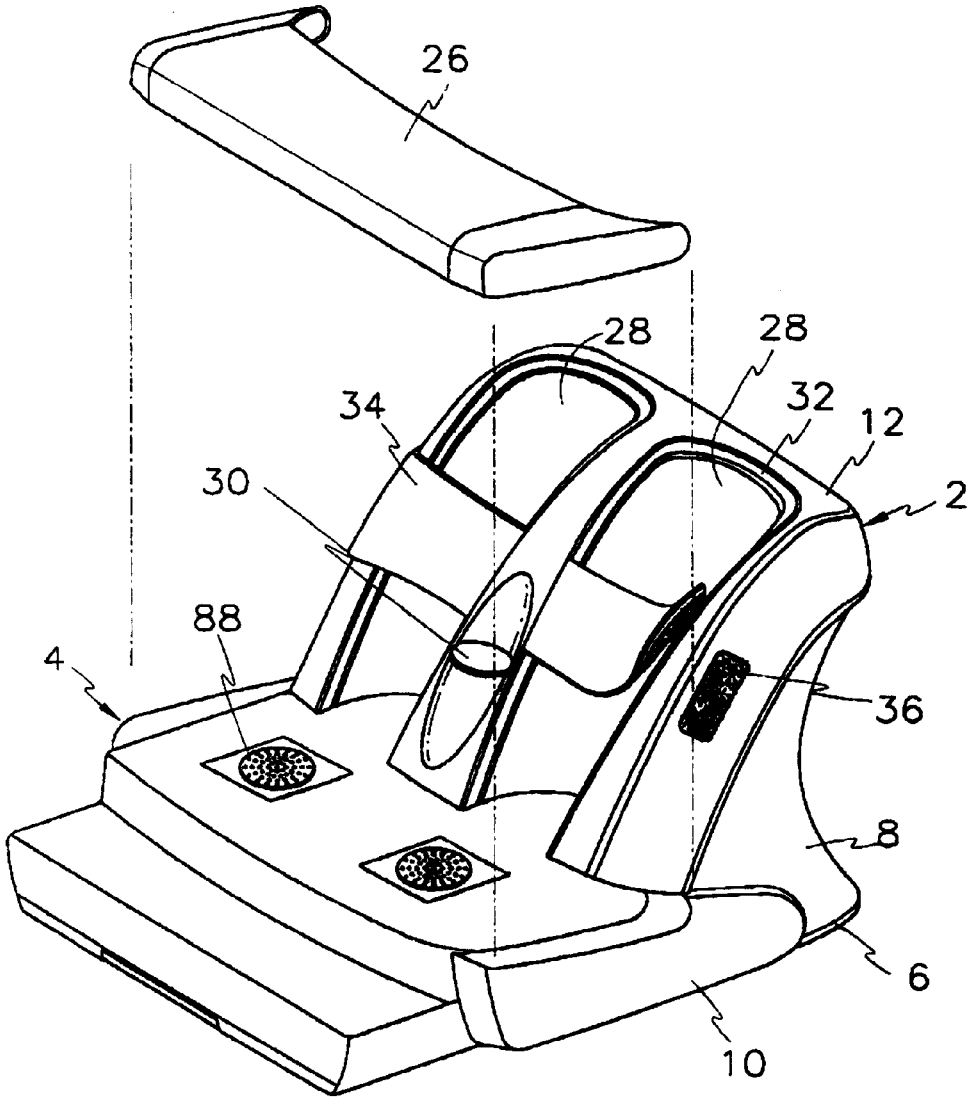
FIG. 2 is a perspective view of a leg massage device depicted in FIG. 1 when a sliding member is withdrawn.
Figure 3:
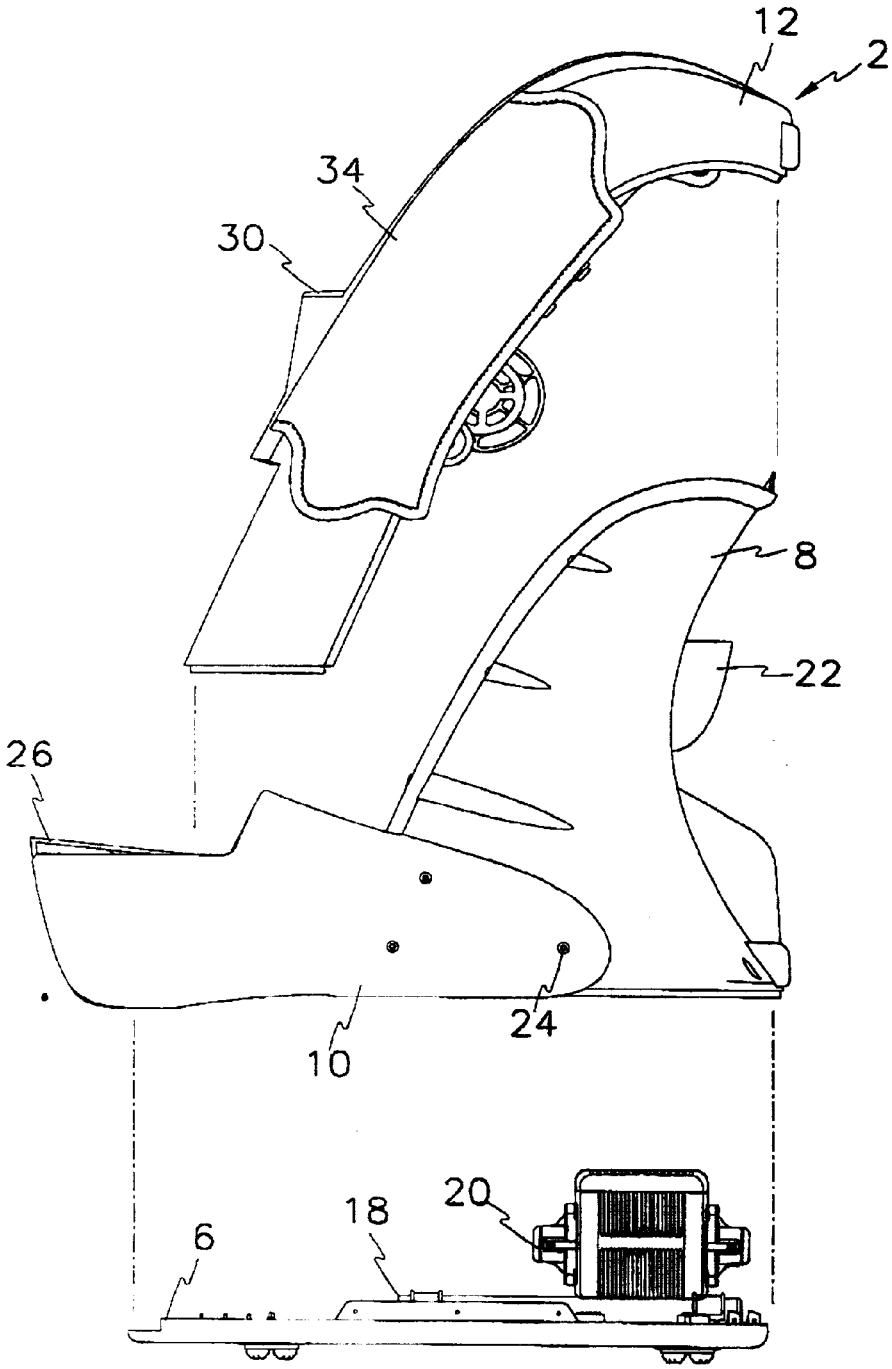
FIG. 3 is an exploded side view of FIG. 1.
Figure 4:
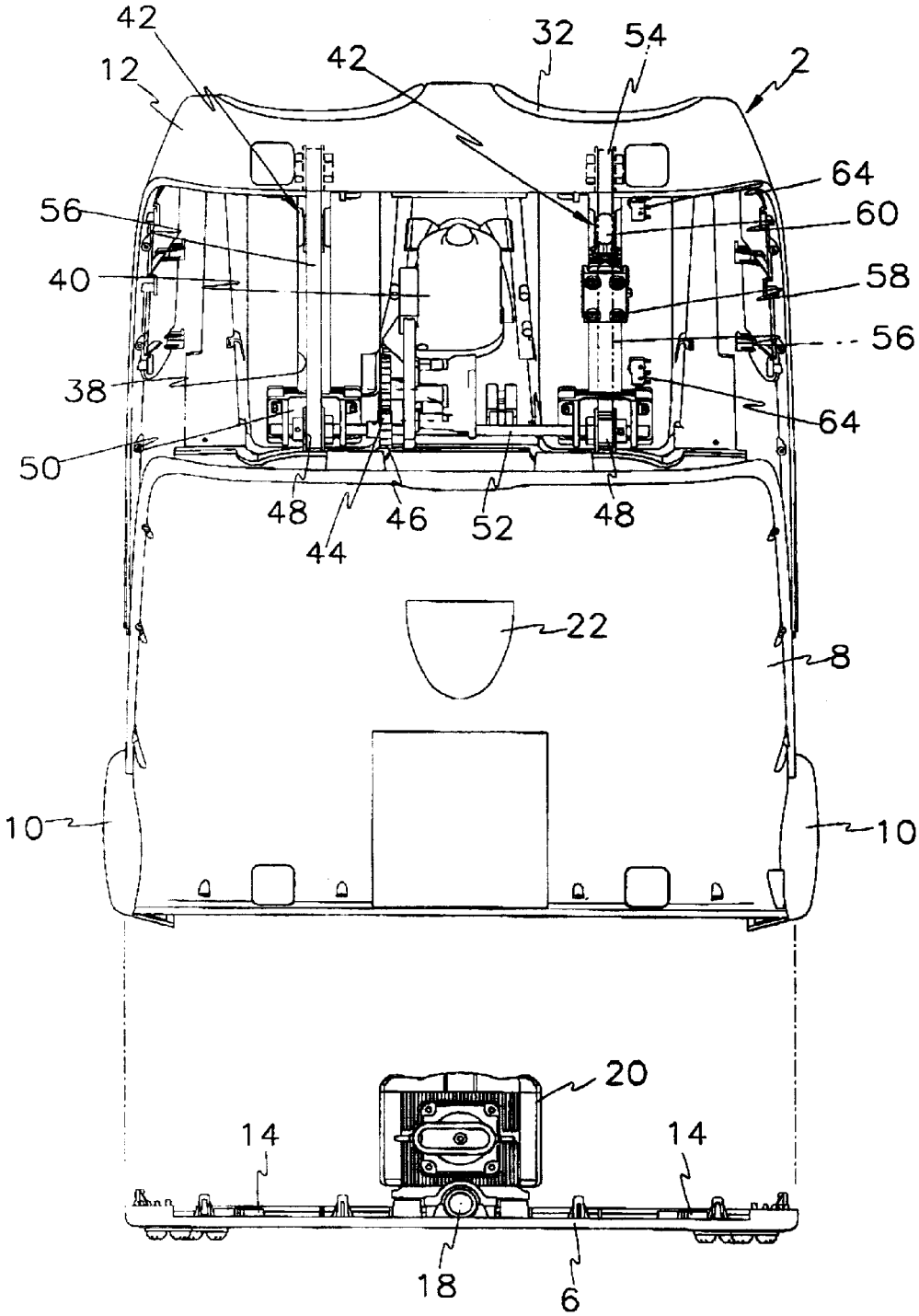
FIG. 4 is a right side view of FIG. 3.
Figure 5:
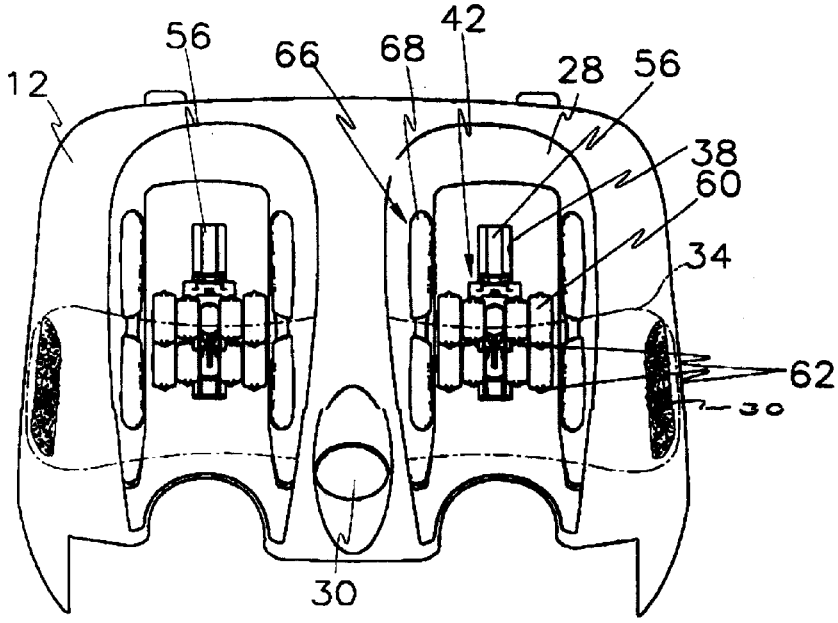
FIG. 5 is a plane view of a main body without a fixing band according to a preferred embodiment of the present invention.
Figure 6:
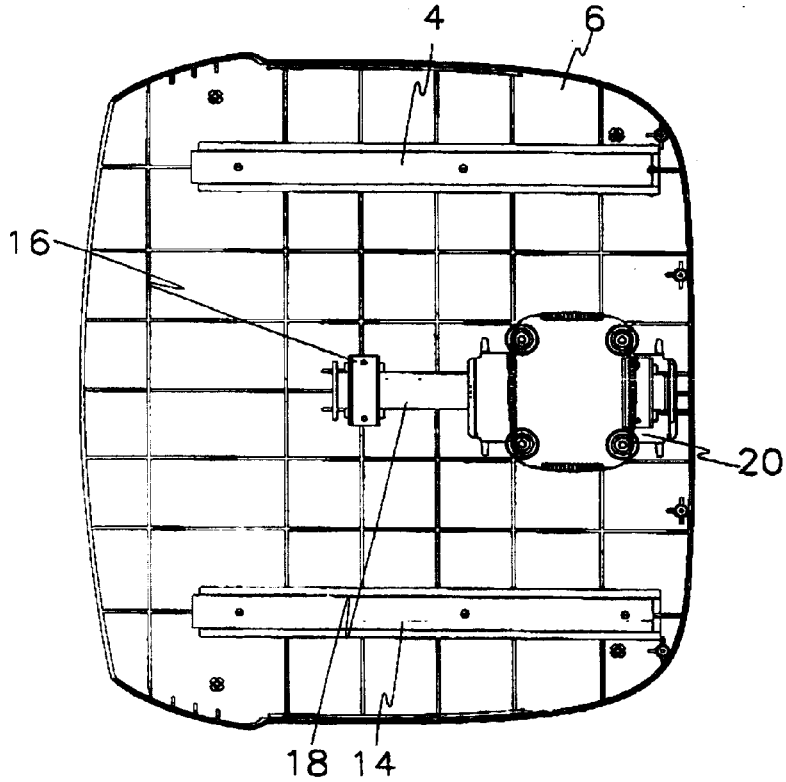
FIG. 6 is a plane view of a base of a main body depicted in FIG. 5.

FIGS. 1 and 2 show a leg massage device according to a preferred embodiment of the present invention.

The inventive massage device comprises a main body 2 and a sliding member 4 slidably received in the main body 2.

As shown in FIGS. 3 to 6, the main body 2 comprises a base 6 defining a bottom of the main body 2, a rear cover 8 detachably assembled on the base 6 to define a rear side of the main body 2, side covers 10 coupled on both sides of the rear cover 8, and a front cover 12 mounted on an upper portion of the rear cover 8 to define the front side of the main body 2. A first massage means for massaging the calf of the leg is mounted on the front cover 12.

Plural guide rails 14 for guiding the sliding movement of the sliding member 4 is formed on the base 6, and a cylinder 18 is mounted on the base 6 between the guide rails 14 and fixed by a fixing member 16.

The guide rails 14 support the sliding member 4 when the sliding member 4 moves out of the main body 2, and the cylinder 18 allows a rod of the sliding member 4 to be tightly inserted into the main body 2, thereby preventing the sliding member 4 from abruptly moving during the insertion operation of the sliding member 4 into the main body 2.

In addition, a pump 20 used during the operation of the first massaging means is mounted on a rear center portion of the base 6.

The rear cover 8 is provided with a signal receiving part 22 for receiving signals from the remote controller (not shown) for controlling the massage device.

The side covers 10 are detachably fixed by a fastener 24 such as a screw on the both sides of the rear cover 8. A cover 26 is mounted on the upper portions of the side covers 10 so as to enclose the sliding member 4 when the massage device is not used.

The front cover 12 is declined rearward and provided at its front portion with a pair of supporting grooves 28 in which the calf is inserted and a signal receiving part 30 for receiving signals from the remote controller.

Sheets are attached on the supporting grooves 28 so as to provide a smooth feeling to the calf inserted between the supporting grooves 28. A fixing band 34 for tightly fixing the leg inserted in the supporting grooves is provided on the front cover 12.

Preferably, the fixing band 34 is formed of fabric and provided with Velcro fastener at its one end, which is detachably attached on the attaching part 36 formed on the front cover 12.

In addition, a slot 38 is longitudinally formed on each of the supporting grooves 28 so that the massage operation of the first massaging means is performed contacting the calf.

The first massage means for massaging the calf of the leg comprises an electric motor 40, power transmission means for converting a rotational motion of the motor 40 into a linear motion, and plural first massage members 42 fixed to the power transmission means and moving along the supporting grooves 28 to massage the calf.

The power transmission means comprises a driving gear 44 coupled to the rotational shaft of the motor 40, a driven gear 46 engaged with the driving gear 44, a driving shaft 52 for fixing the driven gear 46 and plural rotating members 48, the driving shaft 52 being rotatably supported at its both ends on the supporting part 50 to receive the driving force of the motor 40, and a belt 56 connecting the rotating members 48 to a supporting member 54 to convert the rotational motion of the motor 40 into the linear motion.

The first massage members 42 are installed on the belt 56. Each of the first massage members 42 comprises a fixing part 58 fixed on the belt 56 and plural rollers 60 fixed on the fixing part 58 and extending toward the supporting grooves 28 through the slot 38 so as to massage the calf when the belt rotates.

Each of the rollers 60 may be provided at its outer circumference with a plurality of projections so as to enhance the massaging effect.

Limit switches 64 for limiting the reciprocal motion of the first massage members 42 within a predetermined range are mounted on the rear surface of the supporting grooves 28.

As described above, the first massaging means comprises the first massage members 42 that move along the calf in the vertical direction to rub the calf. In addition, the first massaging means may further comprise second massage members 66 that can apply pressure to the calf and release the pressure from the calf so as to perform the kneading massage.

The second massage member 66 comprises an air pump 20 installed on the base 6 and plural pressing members 68 mounted inside the supporting grooves 28.

The second massage member 66 kneads the calf as the air pump supplies and exhausts the air to and from the pressing members at a predetermined cycle.

Second massaging means for kneading the sole of the foot is installed on the sliding member 4 inserted in the main body 2.

Figure 7:
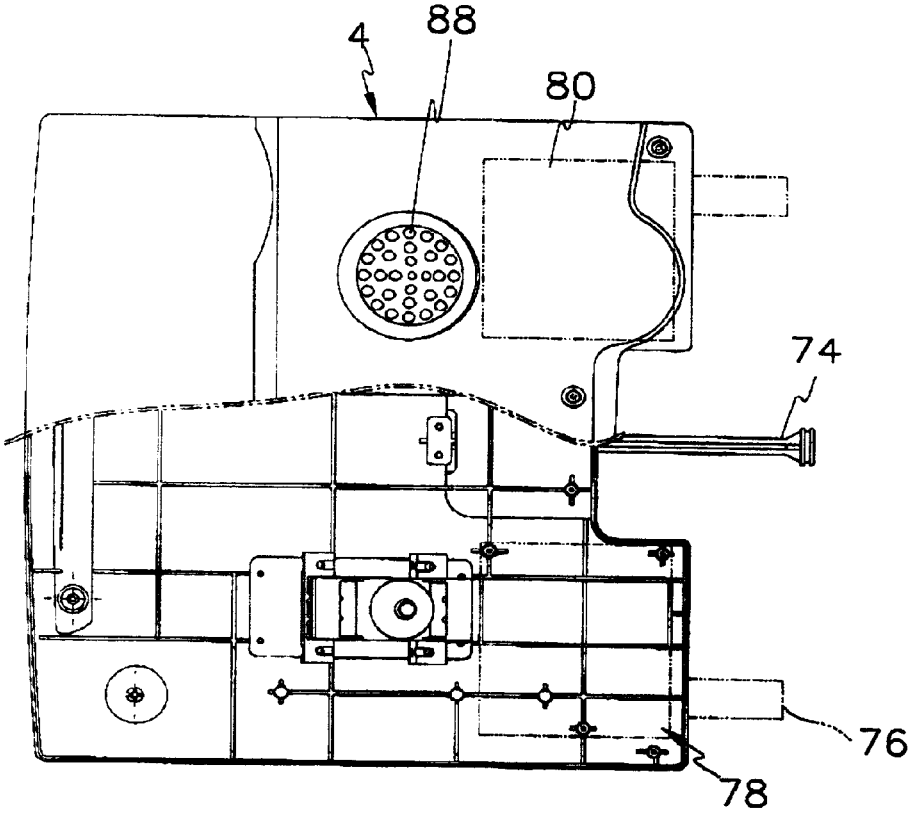
FIG. 7 is a partly broken plane view of a sliding member according to a preferred embodiment of the present invention.
Figure 8:
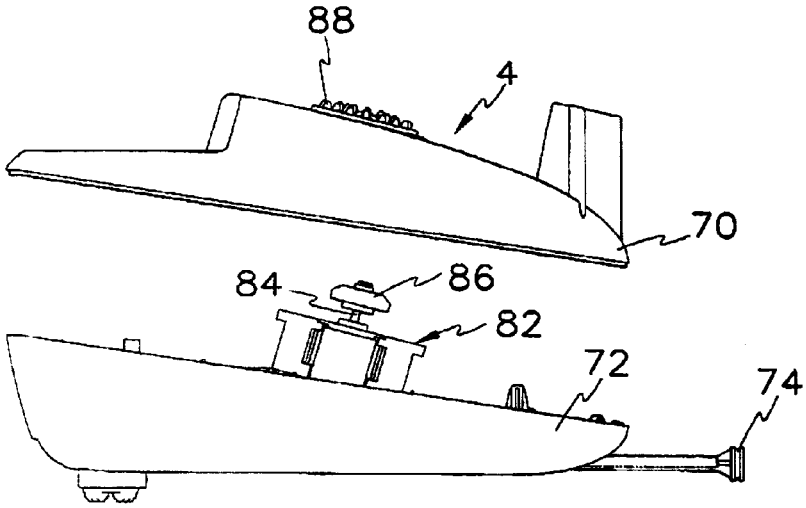
FIG. 8 is an exploded side view of FIG. 7.

As shown in FIGS. 7 and 8, the sliding member 4 comprises upper and lower cases 70 and 72. A rod 74 capable of being inserted into the cylinder 18 of the main body 2 is installed in the lower case 72. In addition, plural slides 76 sliding along the guide rails 14 are fixed on the lower case 72 so that the sliding member 4 can be easily inserted into or withdrawn out of the main body.

The second massaging means is operated by an electric power supplier 80 controlled by a controller 78.

The controller 78 is designed to receive the signal of the signal receiving part 30 formed on the main body as the remote controller is operated.

That is, the controller 78 controls the power supplier 80 so as to control the massage time and mode of the first and second massage means. As this control technology is well known in the art, the detailed description thereof will be omitted herein.

The second massage means comprises a solenoid 82 vibrated by electric power from the power supplier 80 controlled by the controller 78, a impacting part 86 coupled on a front end of an operating shaft 84 of the solenoid 82, and a contacting part 88 for transmitting the power of the impacting part to the sole of the foot.

Figure 9:
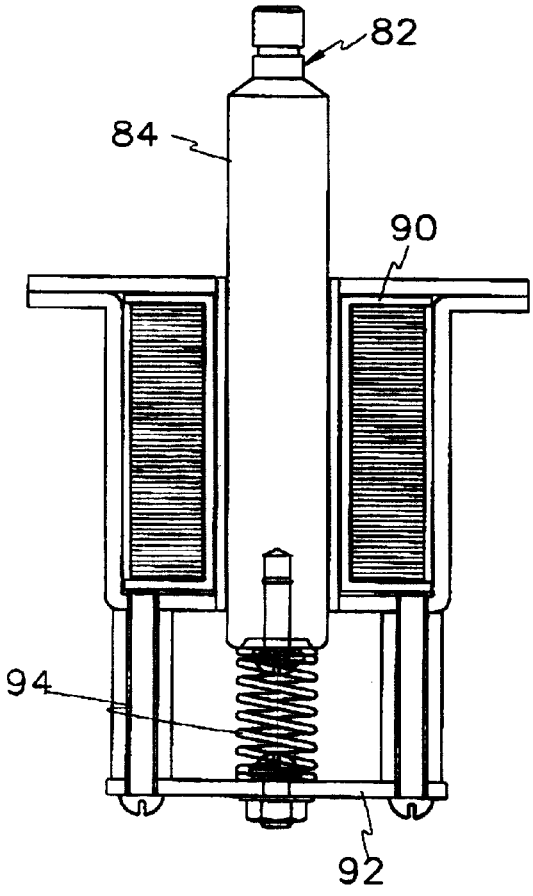
FIG. 9 is a sectional view of a solenoid according to a preferred embodiment of the present invention.

As shown in FIG. 9, the solenoid 82 of the present invention comprises a bobbin 90 with coil turns, the operating shaft 84 inserted into a central hole of the bobbin 90, and a plate 92 disposed spacing away from the bobbin 90 and fixed to the bobbin by a fixing member. An elastic member 94 is disposed between the operating shaft 84 and the plate 92 so as to enhance the smooth operation of the solenoid without noise.

To massage the legs using the above-described massage device, as shown in FIG. 2, the sliding member 3 is first withdrawn from the main body 2, and the fixing band 34 is detached from the attaching portion 36 in a state where the cover 26 is open.

Next, the calf of the leg is inserted into the supporting groove 28, and the sole of the foot steps on the contacting part 88 of the sliding ember 4, after which the fixing band 34 is attached on the attaching part 36 so that the leg tightly contacts the supporting grooves 28.

After the above, the signals on the massage time and mode are transmitted from the remote controller to the signal receiving part 30 so that the air pump 20, the solenoid 82 and the motor 40 are controlled by the controller 78.

By the operation of the air pump 20, the solenoid 82 and the motor 40 controlled by the controller 78, the first and second massage means are selectively operated. That is, the first and second massage means rub or knead the calf and sole of the foot.

Describing more in detail, to operate the first massage member 42 of the first massage means, when the signals on the massage pattern and time are transmitted to the signal receiving part 30, the motor 40 is operated while being controlled by the controller 78.

Then, the driving gear 44 rotates by the rotational force of the motor 40, rotating the driven gear 46 engaged with the driving gear 44 and the driving shaft 52. As a result, the belt 56 suspended on the rotating member 48 and the supporting member 54 reciprocates between the limit switches 64.

By the reciprocation of the belt 56, the rollers of the first massage member 42 coupled to the belt 56 contact the sheet 32 and moves along the leg, thereby massaging the calf in the rubbing-type massage.

In addition, to massage the calf in the kneading-type massage using the second massage member 66, the signals on the pressure and the pressing cycle are first transmitted from the remote controller to the signal receiving part 30, the air pump 20 is operated while being controlled by the controller 78.

By the operation of the air pump 20, air is repeatedly supplied to and released from the pressing part 68 of the second massage member 66, thereby kneading the calf.

To use the second massage means for massaging the sole of the foot, the signals on the blowing cycle and massage pattern are first transmitted from the remote controller to the signal receiving part 30 to control the operation of the solenoid 82 by the controller 78. When the solenoid 82 is operated, the blowing part 86 coupled to the operating shaft 84 blows the sole of the foot, thereby massaging the sole.

Since the elastic member 94 is disposed between the operating shaft 84 and the plate 92, the solenoid 82 can be smoothly operated without generating the noise.

After the massage is finished, the fixing band 34 is detached from the attaching part 36 and the leg gets out of the supporting groove 28.

Then, when the withdrawn sliding member 4 is pushed into the main body 2, the sliding member 4 slides along the guide rails 14 mounted on the base of the main body 2 to be received in the main body 2.

In addition, since the rod 74 installed on the sliding member 4 tightly contacts the cylinder 18 provided in the main body 2, the sliding operation is slowly realized, preventing the abruption movement While this invention has been described in connection with what is presently considered to be the most practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. A massage device comprising:

a main body provided with a supporting groove in which a calf of a leg can be disposed:

a sliding member slidably inserted into the main body; and first massage means for massaging the calf, the first massage means being installed on a rear side of the supporting groove and comprising an electric motor, power transmission means for converting a rotational motion of the motor into a reciprocal motion, and a first massage member for massaging the calf while moving along the supporting groove, the first massage member being fixed on the power transmission means;

wherein the power transmission means comprises a driving gear coupled to a rotational shaft of the motor, a driven gear engaged with the driving gear, a driving shaft for fixing the driven gear and plural rotating members, the driving shaft being rotatably supported at its both ends on a supporting part to receive the driving force of the motor, and a belt connecting the rotating members to a supporting member to convert the rotational motion of the motor into the reciprocal motion.

2. A massage device of claim 1 further comprising second massage means for massaging a sole of a foot, the second massage means being provided on the sliding member.

3. A massage device of claim 1 wherein the first massage member comprises a fixing part fixed on the belt and plural rollers fixed on the fixing part and extending toward the supporting groove through a slot so as to massage the calf when the belt rotates.

4. A massage device of claim 3 wherein the first massage member further comprises a limit switch operated by contacting the fixing part so as to limit a reciprocal distance within a predetermined range.

5. A massage device of claim 2 wherein the second massage means comprises a solenoid vibrated by electric power from a power supplier controlled by a controller, a impacting part coupled on a front end of an operating shaft of the solenoid, and a contacting part for transmitting the power of the impacting part to the sole of the foot.

6. A massage device of claim 5 wherein the solenoid comprises a bobbin with coil turns, the operating shaft inserted into a central hole of the bobbin, and a plate disposed spacing away from the bobbin and fixed to the bobbin by a fixing member.

7. A massage device of claim 6 wherein an elastic member is disposed between the operating shaft and the plate so as to enhance the smooth operation of the solenoid without noise.

8. A massage device of claim 1 wherein the main body is provided with a cylinder, and the sliding member is provided with a rod capable of being inserted into the cylinder, the rod tightly contacting the cylinder so as to prevent an abrupt movement of the sliding member.

9. A massage device comprising:

a main body provided with a supporting groove in which a calf of a leg can be disposed:

a sliding member slidably inserted into the main body; and first massage means for massaging the calf, the first massage means being installed on a rear side of the supporting groove and comprising an electric motor, power transmission means for converting a rotational motion of the motor into a reciprocal motion, and a first massage member for massaging the calf while moving along the supporting groove, the first massage member being fixed on the power transmission means;

wherein the first massaging means further comprises a second massage member that can apply pressure to the calf and release the pressure from the calf so as to perform a kneading massage;

wherein the second massage member comprises an air pump and plural pressing members connected to the air pump.

* * * * *